US007513087B2

(12) United States Patent
Kawanishi et al.

(10) Patent No.: US 7,513,087 B2
(45) Date of Patent: Apr. 7, 2009

(54) PACKAGING SYSTEM

(75) Inventors: Norio Kawanishi, Ritto (JP); Yuuki Tai, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 11/420,794

(22) Filed: May 29, 2006

(65) Prior Publication Data

US 2006/0272283 A1 Dec. 7, 2006

(30) Foreign Application Priority Data

Jun. 1, 2005 (JP) ..... 2005-161047
Feb. 28, 2006 (JP) ..... 2006-051540

(51) Int. Cl.
*B65B 57/00* (2006.01)

(52) U.S. Cl. ..... 53/51; 53/329.4; 53/388

(58) Field of Classification Search ..... 53/51, 53/392.2, 329.3, 329.5, 388, 488, 478, 329.4, 53/485, 392.3
See application file for complete search history.

(56) References Cited

U.S. PATENT DOCUMENTS 3,706,175 A * 12/1972 Anderson ..... 53/478
3,915,282 A * 10/1975 Remensperger ..... 198/456
4,111,412 A * 9/1978 Cathers ..... 271/251
4,162,599 A * 7/1979 Kyle ..... 53/77
5,144,787 A * 9/1992 Whitby et al. ..... 53/66
5,238,099 A * 8/1993 Schroeder et al. ..... 198/456
5,243,808 A * 9/1993 Landrum ..... 53/484
5,299,693 A * 4/1994 Ubaldi et al. ..... 209/3.3
5,407,190 A * 4/1995 Hehn ..... 271/225
5,447,736 A * 9/1995 Gorlich ..... 426/396
5,718,101 A * 2/1998 Noel et al. ..... 53/432
5,927,469 A * 7/1999 Dunifon et al. ..... 198/456
6,170,236 B1 * 1/2001 Whitby et al. ..... 53/441
6,666,005 B1 12/2003 Ohshita et al.
6,851,250 B2 * 2/2005 Whitby et al. ..... 53/493
2002/0062628 A1 5/2002 Whitby et al.

FOREIGN PATENT DOCUMENTS

JP 51-112579 A 10/1976
JP 57-46523 U 3/1982
JP 60-122624 A 7/1985
JP 9-66908 A 3/1997
JP H09-290802 A 11/1997
JP 11-49338 A 2/1999
JP 11-94535 A 4/1999
JP 11-165858 A 6/1999
JP 2001-48109 A 2/2001

* cited by examiner

*Primary Examiner*—Sameh H. Tawfik
(74) *Attorney, Agent, or Firm*—Global IP Counselors, LLP

(57) ABSTRACT

A packaging system is disclosed that packages a product by supplying the product onto a lifter by means of a supply device, pushing the product on the lifter up to a packaging station, and covering the top surface of the product with a film. The packaging system includes a conveying unit that contacts the rear end in the conveying direction of the product on the supply device and configured to convey the product onto the lifter, a detection unit configured to determine the amount of misalignment of the product in the conveying direction and/or the width direction that is orthogonal to the conveying direction, while the product is being conveyed by the conveying unit, and a control unit configured to control the devices in the system to perform in accordance with the amount of misalignment.

4 Claims, 15 Drawing Sheets

PRODUCT INFORMATION STORAGE UNIT 50

| ACCESS NO. | PRODUCT NAME | PRICE | TRAY No |
|---|---|---|---|
| 01 | SIRLOIN STEAK | —— | 08 |
| 02 | BEEF ROUND SLICE | 400 | 09 |
| 03 | SPARE RIBS | 300 | 05 |
| : | : | : | : |

TRAY INFORMATION STORAGE UNIT 51

| No. | DEPTH | WIDTH |
|---|---|---|
| 01 | 130 | 200 |
| 02 | 200 | 300 |
| 03 | 100 | 160 |
| : | : | : |

FIRST
PHOTOGRAPH

TRAY IS
PHOTOGRAPHED
BY CAMERA

SECOND
PHOTOGRAPH

AMOUNT OF
MISALIGNMENT
IS AGAIN DETERMINED
BY CAMERA

PACKAGING SYSTEM

CROSS-REFERENCE TO RELATED APPLICATIONS

This application claims priority to Japanese Patent Application Nos. 2005-161047 and 2006-051540. The entire disclosure of Japanese Patent Application Nos. 2005-161047 and 2006-051540 is hereby incorporated herein by reference.

BACKGROUND OF THE INVENTION

1. Field of the Invention

The present invention relates to a packaging system configured to package a product by covering the top surface of the product with a film.

2. Background Information

In conventional practice, some packaging systems package products with films by means of raising a container, such as a tray or the like, having a product contained therein onto a packaging station arranged thereabove. One example of such a packaging system is shown in FIGS. 8 and 9.

When a product M is placed on a tray supply device 20 shown in FIG. 8 by an operator, the rear end Tb of the tray (container) T carrying the product M is pushed by a conveying bar (contact member) 13, and the tray T is conveyed onto a lifter 201. The posts 210 of the lifter 201 are disposed directly beneath the packaging station S of a packaging unit 200. The posts are capable of being raised and lowered by a hoisting device 208. The lifter 201 lifts the product M up to the packaging station S when the product M is supplied from the tray supply device 20 thereto.

Before the packaging operation, a film F cut to a specific length is supplied to and stretched over the packaging station S in FIG. 9A by a film supply device 202 (shown in FIG. 8). This film F adheres to the top surface of the product M when the product M is pressed upward. In this state, a film folding unit 203 packages the product M by folding the edges on all four sides of the film F onto the bottom side of the tray T with a pair of left and right folding plates 204, 204, a rear folding plate 205, a rod-shaped front folding member 206, and a pusher 207 (shown in FIG. 8), and the packaged product M is ejected onto an ejecting conveyor 209 shown in FIG. 8.

However, the tray T may be somewhat misaligned to the left or right because it is placed on the tray supply device 20 by an operator. In order to solve this problem in this type of conventional packaging system, as disclosed in Japan Patent Application Publication 2001-48109 (particularly FIG. 5 thereof), the amount by which the tray T is misaligned in the width direction on the tray supply device 20 is determined, and this widthwise misalignment is corrected in order to improve the finished state of packaging.

In a conventional packaging system, as shown in FIG. 6A, the tray T is photographed from above by a camera when the tray T is placed on the tray supply device 20 (shown in FIG. 8). The amount of misalignment from the center of the tray T is calculated based on this photograph information. After the photographing, the tray T is conveyed by a conveying bar 13, as shown in FIG. 6B, and then the tray T is moved towards the center by a movement unit (not shown in the figures) according to the amount of misalignment, as shown in FIG. 6C.

However, sometimes the amount of misalignment changes when the conveying bar contacts with the tray, due to factors such as the weight of the materials to be packaged, the center of gravity, and the friction between the underside of the tray and the scale tray, even if the tray is positioned in the same manner and at the same position. For example, when the tray T is placed so as to be tilted with respect to the conveying bar 13, as shown in FIGS. 6D and 6E, the amount of post-conveyance misalignment of the tray T after it is conveyed and in contact with the conveying bar 13 may differ from the calculated misalignment, as shown in FIGS. 6D and 6E. Therefore, sometimes the misalignment cannot be sufficiently corrected, even if the tray T is moved towards the center in accordance with the amount of misalignment determined by the camera.

Thus, sometimes the misalignment in the width direction, which is substantially orthogonal to the conveying direction of the products, cannot be resolved from the time conveying is initiated by the conveying unit until the time conveying is completed.

An inadequately corrected misalignment sometimes brings about a misalignment in the position of the product during packaging or a misalignment in the label attachment position. As a result, packaging is unsatisfactory, or the attachment position is misaligned. In addition, a large misalignment may even cause the tray T to be crushed.

Furthermore, misalignment can also occur in the conveying direction of the product.

FIGS. 7A-7H are schematic side views showing the vicinity of the tray supply device 20 and a lifter 201. FIGS. 7A and 7B show a normal conveying state of the tray T. The tray T shown in FIG. 7A is pushed by the conveying bar 13, and is conveyed onto the lifter 201 as shown in FIG. 7B. The position (stopping position) of the end of the advancing movement of the conveying bar 13 is set in advance for each tray T, and the tray T is pushed and conveyed to a specific position on the lifter 201 according to this set stopping position.

However, in cases such as when a tray T carrying a product is light in weight, as shown in FIGS. 7C and 7D, the conveying bar 13 sometimes slips underneath the tray T, and the tray T will not be conveyed to the specified position on the lifter 201 even if the conveying bar 13 stops at the set stopping position.

In addition, if the tray T is deep, as shown in FIGS. 7E and 7F, the conveying bar 13 sometimes slips in underneath the edge of the tray T, and the tray T will not be conveyed to the specified position on the lifter 201.

In view of the above, it will be apparent to those skilled in the art from this disclosure that there exists a need for an improved packaging system. This invention addresses this need in the art as well as other needs, which will become apparent to those skilled in the art from this disclosure.

SUMMARY OF THE INVENTION

The packaging system of the present invention can be applied to a packaging device that uses stretched films or the like.

A primary object of the present invention is to provide a packaging system that is capable of packaging products based on the amount of misalignment that occurs in the conveying direction of the product and the width direction of the product after the product is conveyed.

In the invention disclosed in Japan Patent Application Publication No. 2001-48109, when the misalignment of the product is corrected, the conveying surface itself is moved in the width direction of the product according to the amount of misalignment of the product. Since the conveying surface is accommodated within the main body frame of the packaging system, the product sometimes protrudes past the outside of the conveying surface and cannot be conveyed in a stable manner when the product is too wide, or when the amount of misalignment in the width direction is too great. Moreover, since there is a natural limit to the moveable range of the conveying surface in the width direction, the amount of misalignment of the product cannot be corrected to a great extent.

Therefore, another object of the present invention is to provide a packaging system that can convey products in a more stable manner, and is capable of correcting a large amount of misalignment.

In order to achieve these objects, the packaging system according to a first aspect of the present invention is a packaging system configured to package a product by supplying a product onto a lifter by means of a supply device, pushing the product on the lifter up to a packaging station, and covering the top surface of the raised product with a film. The packaging system comprises a conveying unit that contacts the rear end in the conveying direction of a product on the supply device and configured to convey the product onto the lifter, a detection unit configured to determine the amount of misalignment in the conveying direction and/or the width direction that is orthogonal to the conveying direction of the product, while the product is being conveyed by the conveying unit, and a control unit configured to control the devices in the system to perform in accordance with the amount of misalignment detected.

According to the first aspect, it is possible to determine the misalignment of a product, including the misalignment that did not exist before the product began to be conveyed, or, in other words, the misalignment that occurs as a result of the product being conveyed. Therefore, a highly precise positioning of the product is possible because the final amount of misalignment of the product will be detected after the conveyance of the product begins.

According to the first aspect, in situations in which the amount of misalignment in the width direction is detected, it is preferable that the detection unit also determine the amount of misalignment of the product in the width direction after the product is placed on the supply device and before the product begins to be conveyed.

The initial amount of misalignment of the product can thereby be quickly detected, immediately after the product is placed, and therefore, it is possible to quickly respond to the misalignment of the product. In addition, a highly precise positioning of the product is possible, because the final amount of misalignment of the product is detected after the conveyance of the product begins.

According to the first aspect, in situations in which the misalignment in the width direction is corrected, it is preferable that the packaging system further comprises a moving unit that is configured to move the position of the product on the supply device in the width direction, wherein the control unit drives the moving unit to move the position of the product in accordance with the amount of misalignment in the width direction as detected by the detection unit, to correct the misalignment of the product in the width direction.

As a result, a well finished packaging can be expected because it is possible to correct a misalignment in the width direction that occurs after the conveyance of the product begins.

According to the first aspect, the packaging system may include a film supply device configured to convey the film in the width direction of the product, wherein the control unit drives the film supply device to convey the film according to the amount of misalignment in the width direction as detected by the detection unit, and stretches the film to a position in the width direction corresponding to the misalignment of the product.

As a result, a well finished packaging can be expected because the film supply position can be adjusted according to the misalignment in the width direction that occurs after the conveyance of the product begins.

According to the first aspect, when the product includes a tray, the type of tray may be identified by the system after the tray begins to be conveyed.

The precision in identifying the tray is thereby improved, because the tray is identified after the position of the tray is corrected, and after conveyance has started.

According to the first aspect, it is preferable that the control unit drive the conveying unit to convey the product in accordance with the amount of misalignment in the conveying direction as detected by the detection unit, and correct the misalignment of the product in the conveying direction.

As a result, a well finished packaging can be expected because it is possible to correct the misalignment in the conveying direction that occurs after the conveyance of product has started.

According to the first aspect, in situations in which the amount of misalignment in the conveying direction is detected, it is preferable that the detection unit detects the position of a contact member that comes into contact with the rear end of the product and the position of the rear end of the product, and detects the amount of misalignment of the product in the conveying direction based on the detected positional relationship between the contact member and the rear end of the product.

The product can thereby be supplied to a specific position on the lifter because even if relative misalignment occurs between the contact member and the product, the misalignment thereof will be detected.

According to the first aspect, the packaging system may further include a label attaching device configured to attach a label to a packaged product, wherein the position where the label is to be attached by the label attaching device is controlled by the control unit, and the label is attached to a position in accordance with the amount of misalignment of the product in the conveying direction and/or the width direction, as detected by the detection unit.

As a result, the label can still be attached to the correct position even if the product is misaligned.

The packaging system according to a second aspect is a packaging system configured to package a product by supplying a product onto a lifter, pushing the product on the lifter up to a packaging station, and covering the top surface of the raised product with a film. The packaging system comprises a first conveying surface on which a product is placed; a second conveying surface that is provided downstream of the first conveying surface and formed separately from the first conveying surface, and capable of moving within a specific range in a first or a second width direction that is substantially orthogonal to the conveying direction of the product; a conveying unit configured to convey the product from the first conveying surface onto the lifter through the second conveying surface; a detection unit configured to determine the direction of misalignment and the amount of misalignment of the product in the width direction on the first conveying surface; a moving unit configured to move the position of the product on the second conveying surface in the width direction by moving the second conveying surface in the width direction within the moveable range; and a control unit configured to drive the moving unit to pre-move the second conveying surface in a first or a second width direction in accordance with the direction and amount of misalignment in the width direction detected by the detection unit before the product is conveyed onto the second conveying surface, and also to move the second conveying surface in a first or a second width direction that is opposite the pre-moved width direction after the product has been conveyed onto the second conveying surface, to correct the misalignment of the product in the width direction.

It is possible to correct a considerable misalignment of a product in the width direction on the first conveying surface, by moving the second conveying surface in the width direction in advance. An excellent packaging finish can therefore be expected.

In a second embodiment of the present invention, the width of the second conveying surface is smaller than the width of the first conveying surface.

Since the second conveying surface is moved in advance according to the misalignment of the product, the entire product is transferred onto the second conveying surface when the product is transferred from the first conveying surface to the second conveying surface, even if the width of the second conveying surface is smaller than the width of the first conveying surface. Therefore, an excellent packaging finish can be expected because the position of the product is not disoriented while the product is being conveyed.

In another preferred embodiment of the present invention, the conveying unit comprises a first conveying unit that is in contact with the rear end of the product on the first conveying surface and configured to convey the product in the conveying direction, and a second conveying unit configured to move the second conveying surface along a direction orthogonal to the conveying direction, wherein the second conveying speed of the second conveying unit is set to a greater value than the first conveying speed of the first conveying unit.

In this embodiment, since the conveying speed of the second conveying surface is greater than that of the first conveying surface, the product on the second conveying surface is separated from the first conveying unit that pushes on the rear end of the product. Frictional force is therefore unlikely to act between the rear end of the product and the first conveying unit when the product is displaced in the width direction. Therefore, an excellent packaging finish can be expected because the position of the product is not likely to be disoriented.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
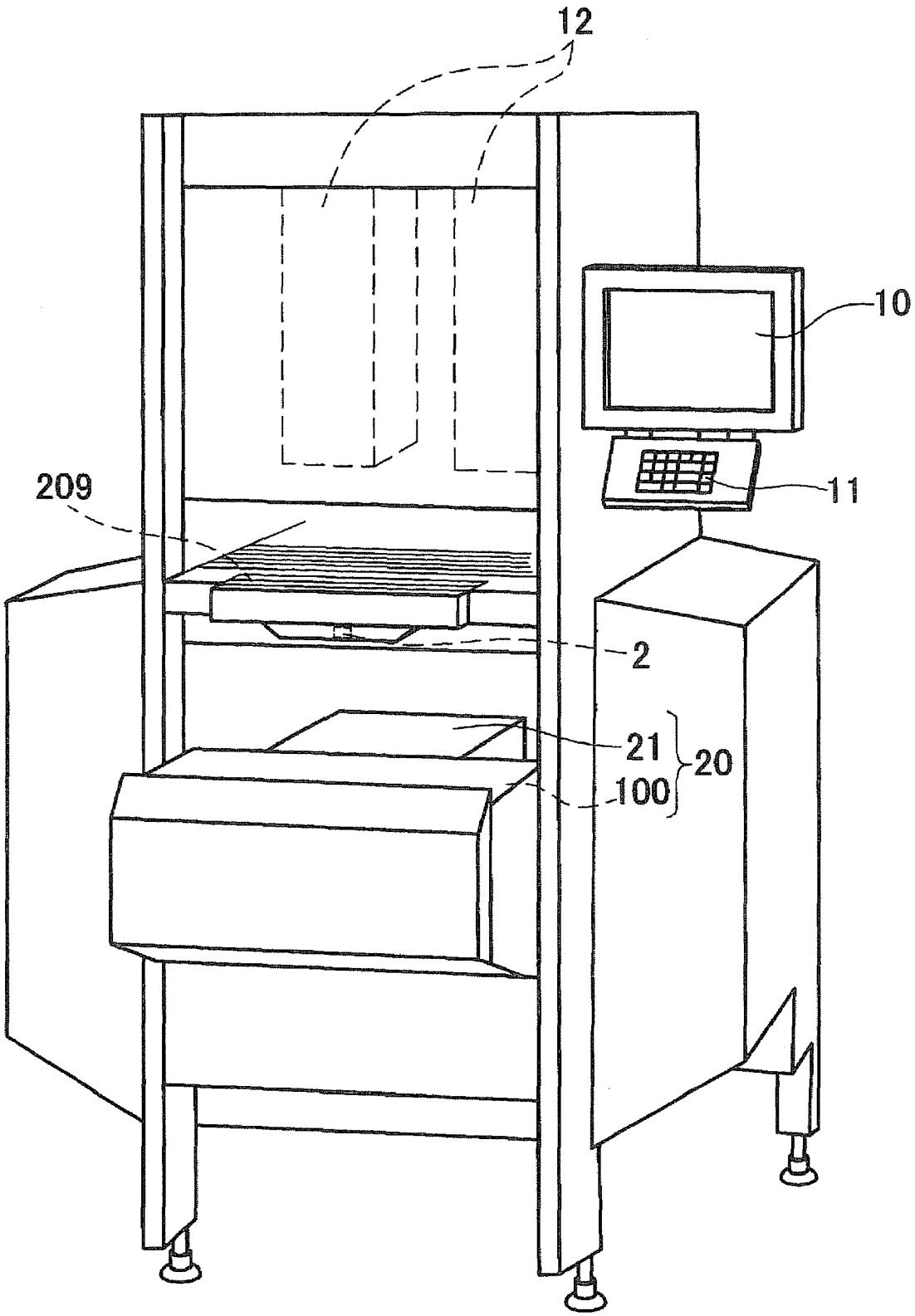
FIG. 1 is a schematic perspective view showing a weighing, packaging, and pricing device in a packaging system according to a first embodiment of the present invention.
Figure 8:
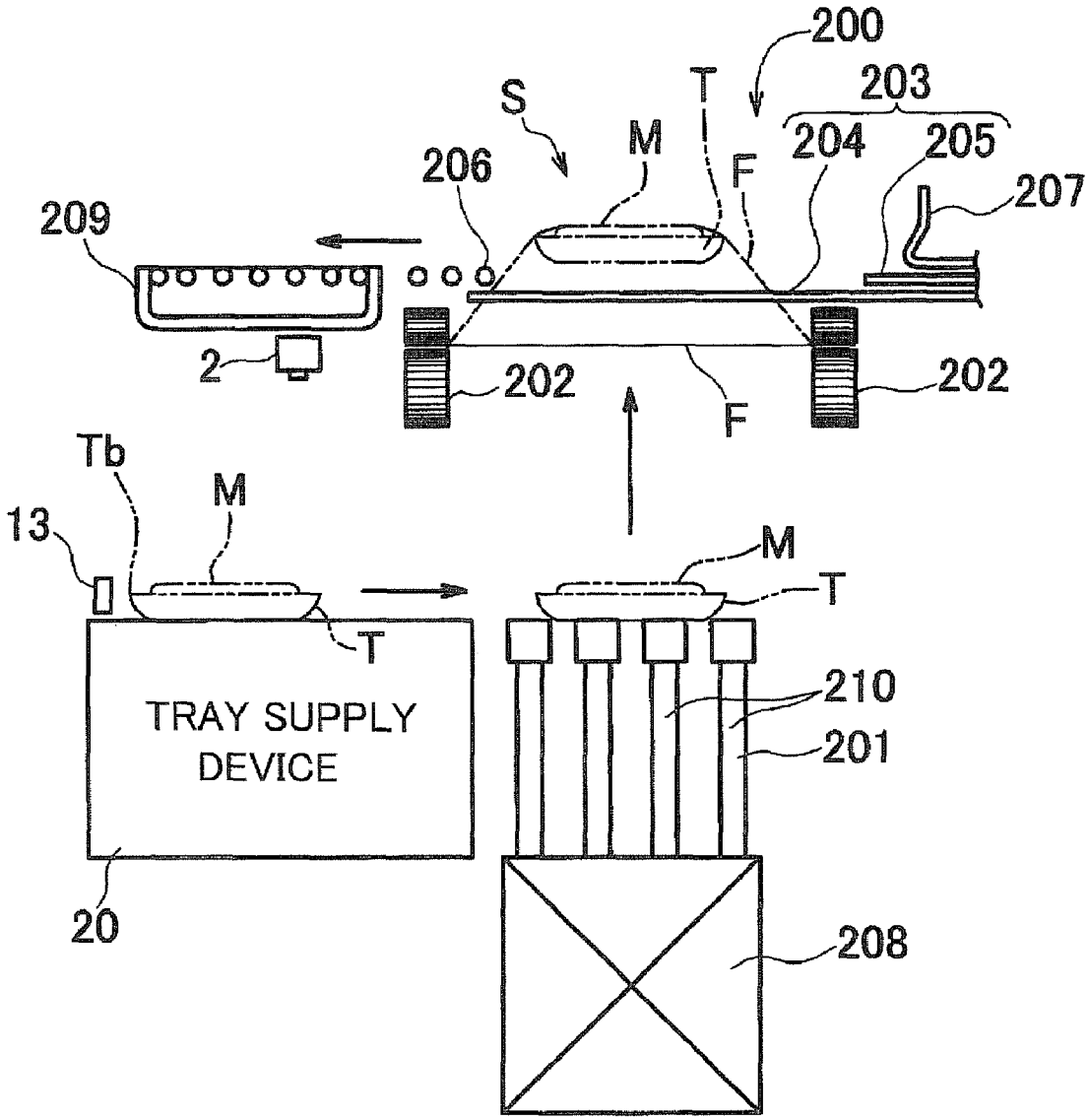
FIG. 8 is a schematic section view showing an example of a packaging unit.
Figure 9A:
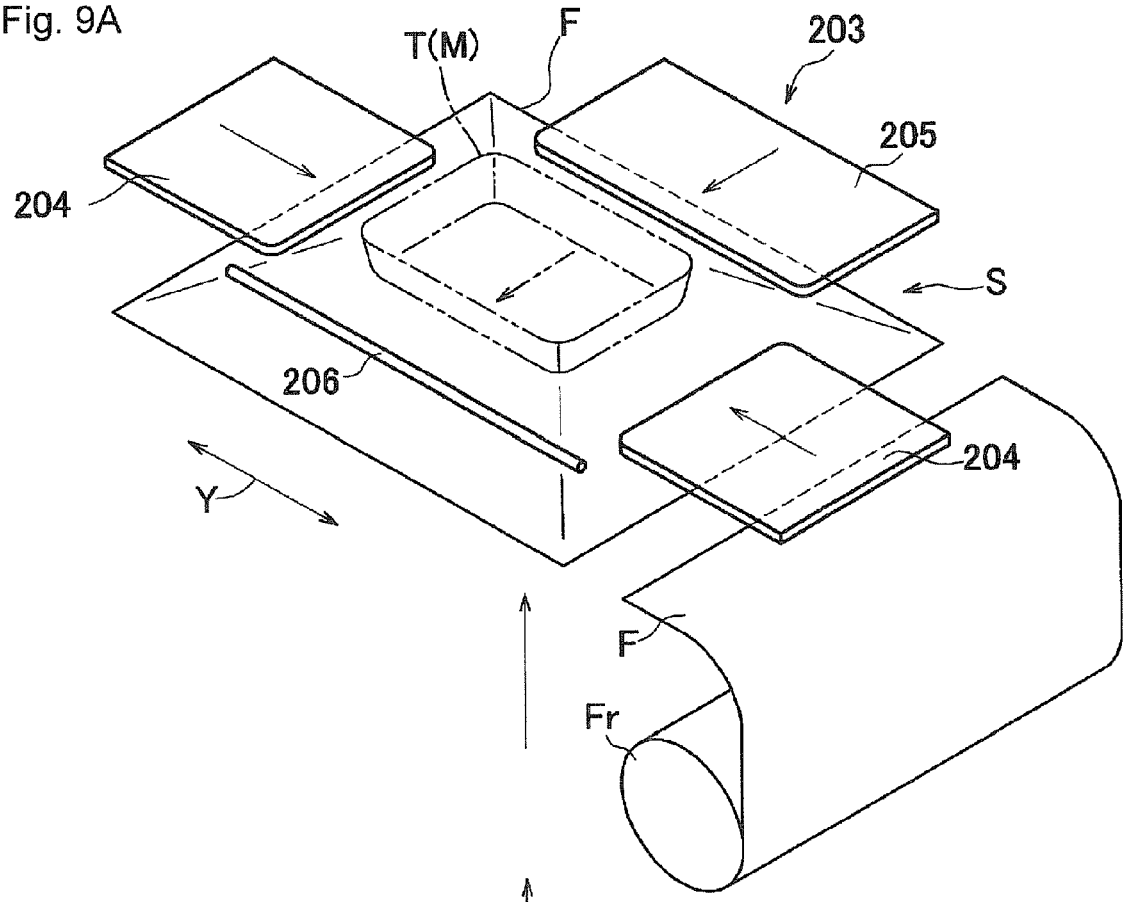
FIGS. 9A and 9B are schematic perspective views showing an example of a packaging method.
Figure 9B:
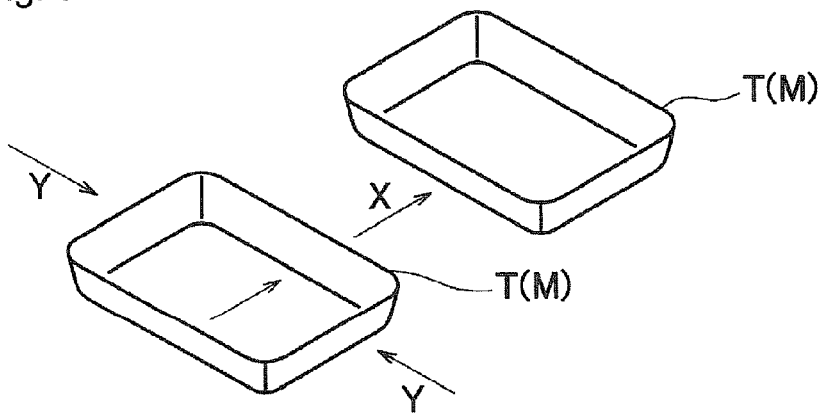

FIG. 1 shows a weighing, packaging, and pricing device in a packaging system in accordance with a first embodiment of the present invention. The weighing and packaging units of this device are somewhat similar to those in the conventional packaging system shown in FIG. 8, and thus only the components of the present invention that are different from this conventional packaging system will be described below. The following description relates to a situation in which a product M is conveyed after being placed on a tray T. The term "product M" includes both the tray T and the contents included therein.

Figure 2:
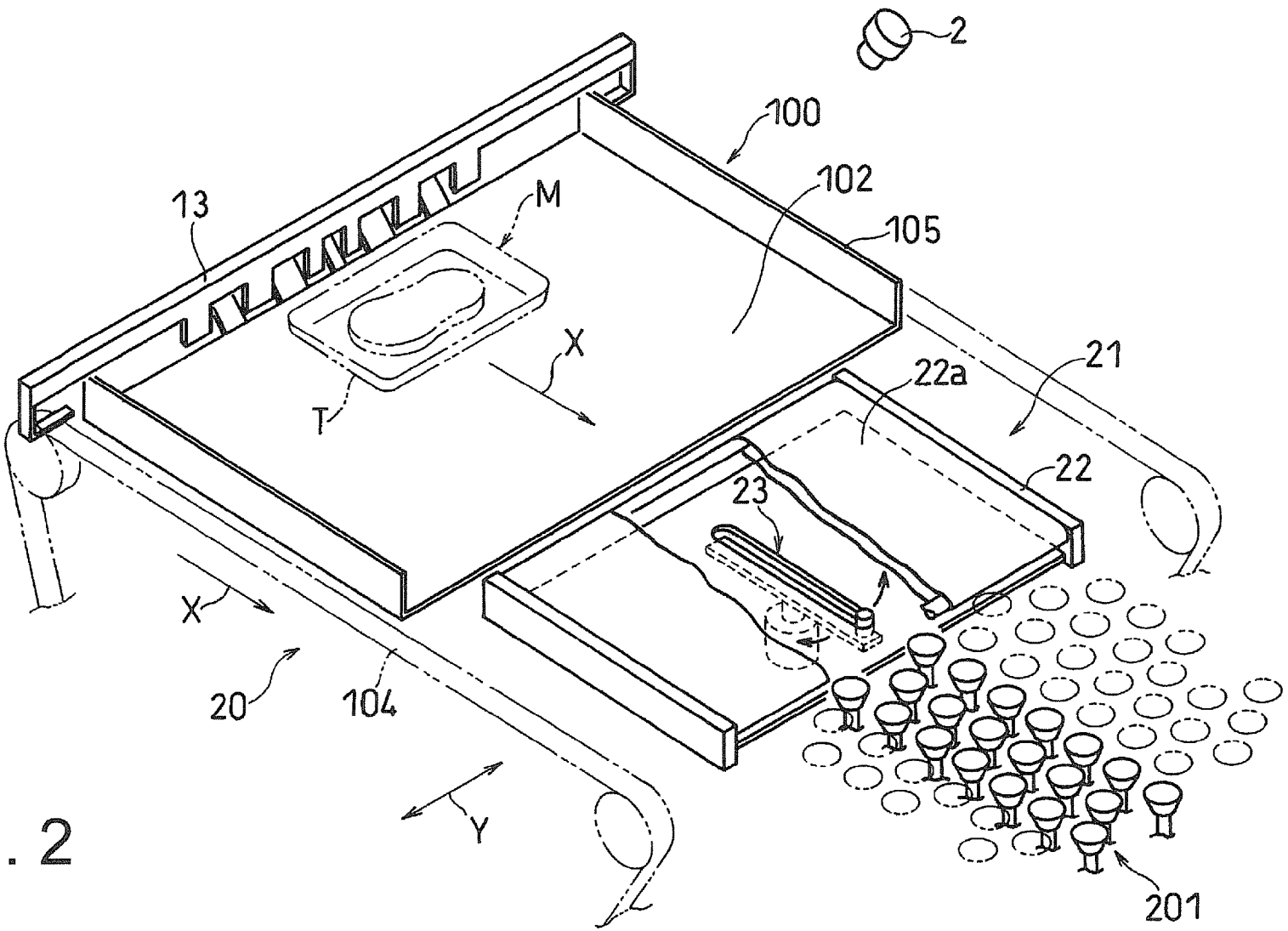
FIG. 2 is a partial cross-sectional, schematic perspective view showing the structure of the supply device.

In FIG. 1, the weighing, packaging, and pricing device is provided with a tray supply device 20 that protrudes forward from the main body thereof. As shown in FIG. 2, the tray supply device 20 comprises a weighing conveyor 100 and a correcting conveyor (moving unit) 21. A label attaching device 12 configured to attach a label to a packaged product M is provided above the ejecting conveyor 209 in FIG. 1.

The weighing conveyor 100 shown in FIG. 2 comprises a resin plate 105 that forms a first conveying surface 102, a conveying bar 13 configured to convey the tray T on the first conveying surface 102, and a drive motor 16 (shown in FIG. 4A) and a driving chain 104 configured to drive the conveying bar 13. Therefore, the conveying bar 13, the drive motor 16, and the driving chain 104 constitute part of the first and second conveying units for conveying the product M onto the lifter 201.

Figures 4A, 4B, 4C:
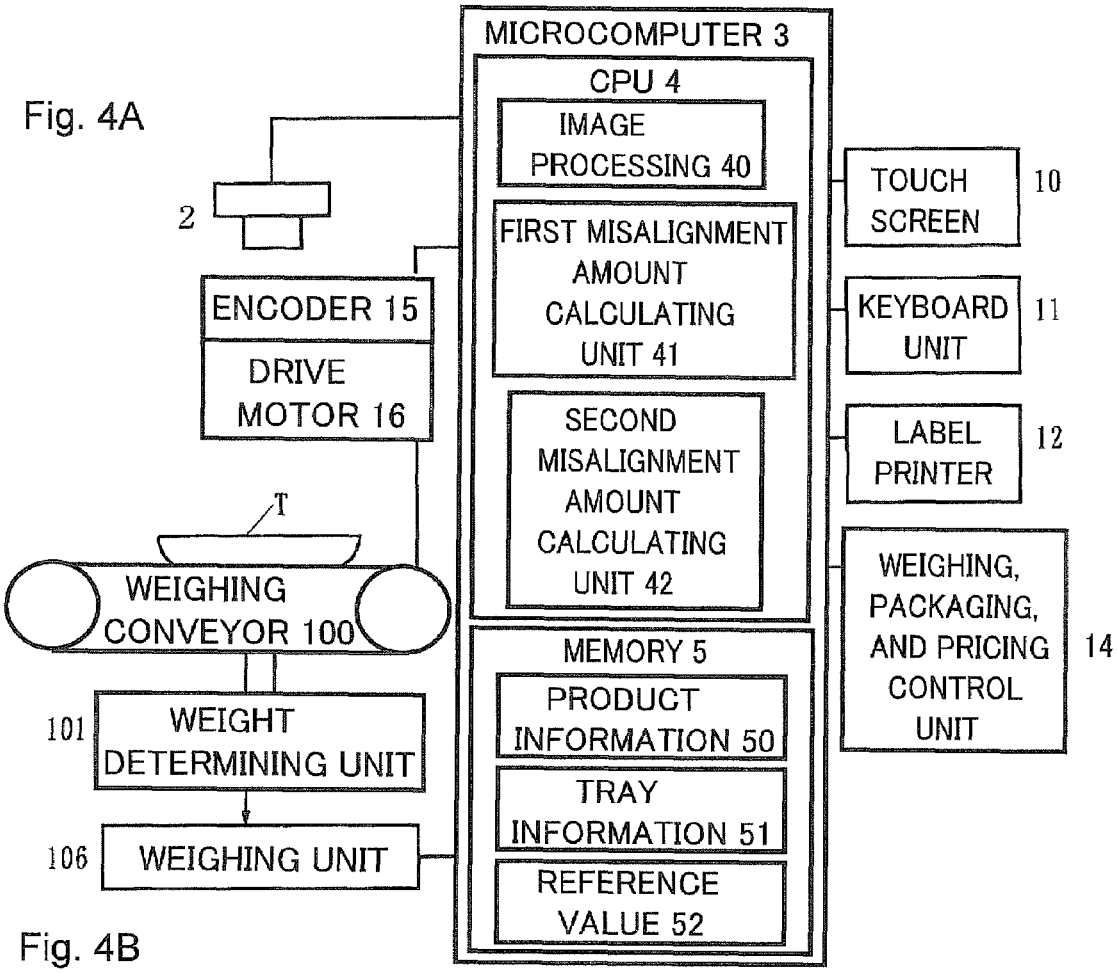
FIG. 4A is a schematic structural view of the system.
FIGS. 4B and 4C are tables showing the stored content of a storage unit.

In the weighing conveyor 100, the resin plate 105 that forms the first conveying surface 102 is supported on a weight determining unit (loading cell) 101 shown in FIG. 4A. The weight detected by the weight determining unit 101 is outputted to weighing unit 106 and inputted to a microcomputer (control unit) 3.

Figure 3:
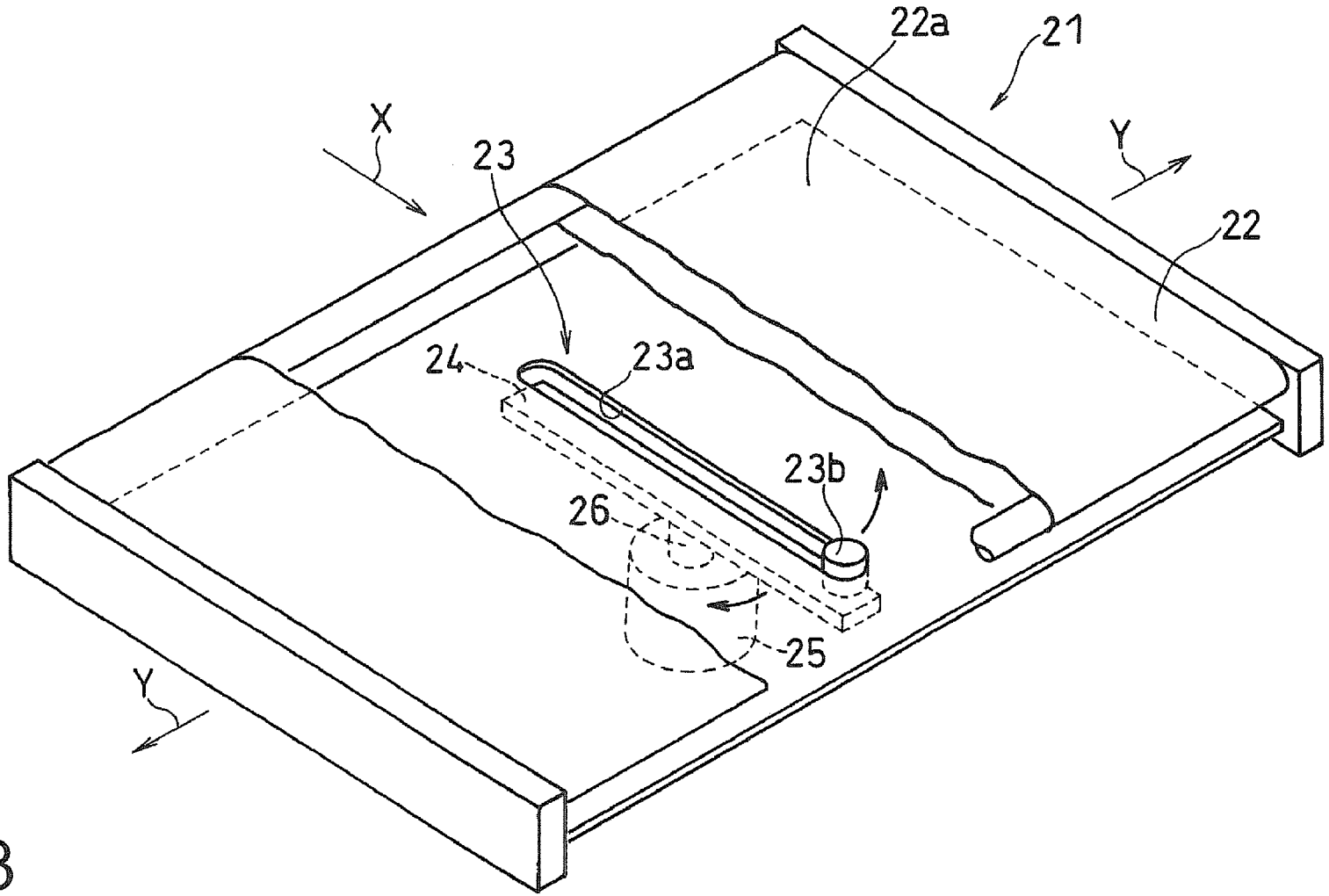
FIG. 3 is a partial cross-sectional, schematic perspective view showing a correcting conveyor.

The correcting conveyor 21 is provided downstream of the resin plate 105 of the weighing conveyor 100 shown in FIG. 2. This correcting conveyor 21 comprises a conveyor (part of the second conveying unit) 22 and a cam unit (part of the moving unit) 23, as shown in FIG. 3. The conveyor 22 forms a second conveying surface 22*a*. The conveyor 22 is arranged to freely move in the width direction Y orthogonal to the conveying direction X of the product M while the movement of the conveyor 22 in the conveying direction X is restricted, and the conveyor 22 is supported by the cam unit 23.

The cam unit 23 comprises a cam groove 23*a* formed on a flat panel, and an engaging pin 23*b* that slidably engages with the cam groove 23*a* . The engaging pin 23*b* is coupled with the output axle 26 of a motor 25 via a drive arm 24. In the cam unit 23, the engaging pin 23*b* slides within the cam groove 23*a* as the engaging pin 23*b* rotates in the directions shown by the arrows, corresponding to the rotation of the motor 25 rotating in a forward and backward direction, which moves the conveyor 22 in the width direction Y. The movement of the conveyor 22 causes the position of the product M on the tray supply device 20 to move in the width direction Y.

Control Configuration

FIG. 4A shows the control configuration of this packaging system.

The microcomputer (control unit) 3 is equipped with a CPU 4 and a memory 5. A touch screen 10, a keyboard unit 11, a label printer 12, and a weighing, packaging, and pricing control unit 14 are connected to the microcomputer 3. In addition, a CCD camera (part of the detection unit) 2 and the weighing unit 106 are connected to the microcomputer 3.

Figure 6A:
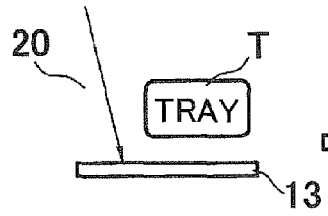
FIGS. 6A through 6C are schematic plan views showing a conventional method of conveying a product.
Figure 6B:
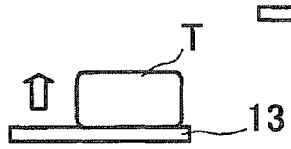
Figure 6C:
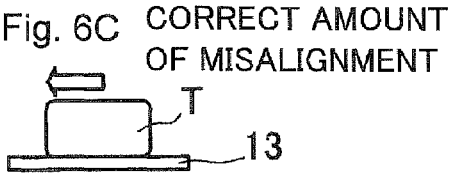
Figure 6D:
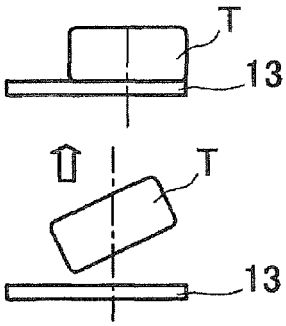
FIGS. 6D and 6E are schematic plan views showing the manner in which the position of the product is misaligned during conveying.
Figure 6E:
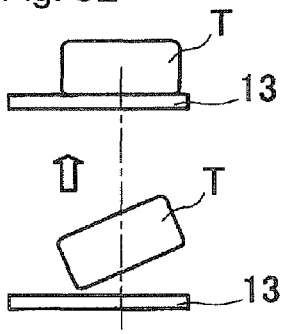
Figure 6F:
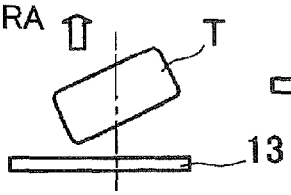
FIGS. 6F through 6I are schematic plan views showing a detection method of the present invention.

The CCD camera 2 is arranged above the first conveying surface 102 as shown in FIG. 2, and almost the entire first conveying surface 102 is in view thereof. As shown in FIG. 6F, when the product M (tray T) is placed on the first conveying surface 102 by an operator, the weight determining unit 101 detects a change in weight, which triggers the camera 2 to photograph the product M, and a first video signal is outputted to the microcomputer 3 (shown in FIG. 4A).

Figure 6G:
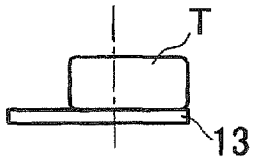
Figure 6H:
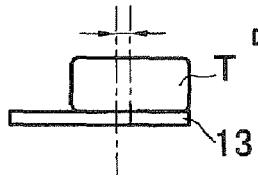
Figure 6I:
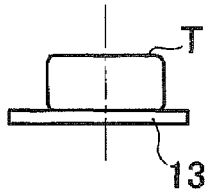

Then, as shown in FIGS. 6G and 6H, the camera 2 photographs the conveyed product M again when the product M is conveyed to a specific position by the conveying bar 13, and a second video signal is outputted to the microcomputer 3 in FIG. 4A.

Misalignment Correction in Width Direction Y

The CPU 4 of the microcomputer 3 in FIG. 4A calculates the amount of misalignment in the width direction Y of the product M with the method described below.

Figure 5A:
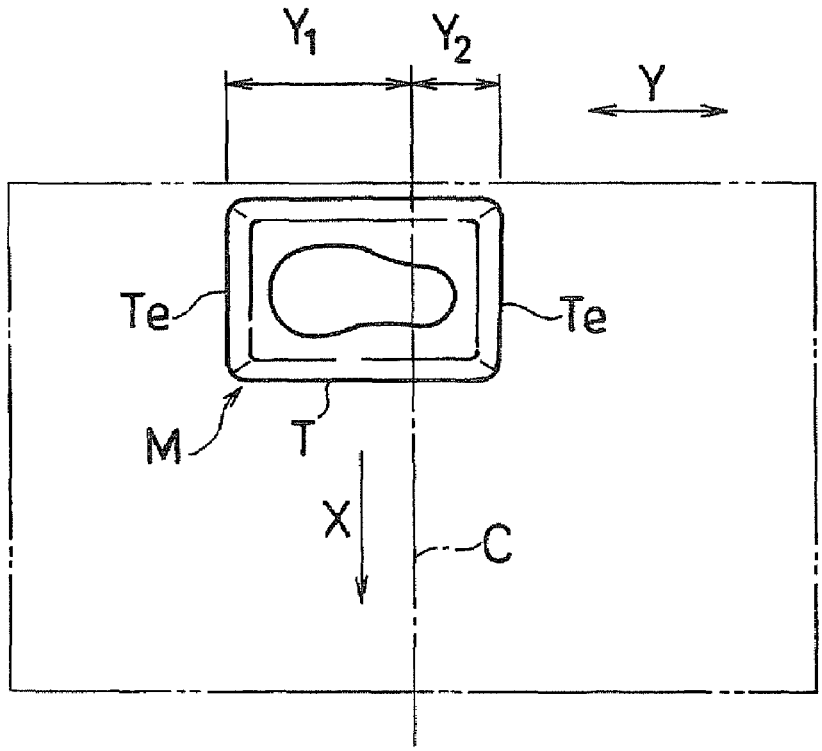
FIG. 5A is a schematic view showing a method for determining the amount of misalignment of the tray.

The CPU 4 comprises an image processing unit 40, a first and a second misalignment calculating unit 41 and 42, and the like in the interior thereof. The image processing unit 40 locates the two edges Te, Te of the product M (tray T) in FIG. 5A in the width direction Y based on the video signals inputted from the CCD camera 2. The first misalignment calculating unit 41 detects the amount of misalignment of the product M by finding the distances Y1 and Y2, from the edge Te and edge Te to the center reference line C respectively, and subtracting the distance Y2 from the distance Y1.

The amount of misalignment is calculated for both the first and second video signals.

The memory 5 shown in FIG. 4A comprises a product information storage unit 50, a tray information storage unit 51, and a reference value storage unit 52.

A reference value YS is stored in the reference value storage unit 52. Based on the first video signal, the CPU 4 moves the correcting conveyor 21 from its original position in advance when the first amount of misalignment calculated by the first misalignment calculating unit 41 is equal to or greater than the reference value YS, for example, 25 mm.

Subsequently, a second photograph is then taken when the product M is conveyed to a specific position by the conveying bar 13.

Figure 5B:
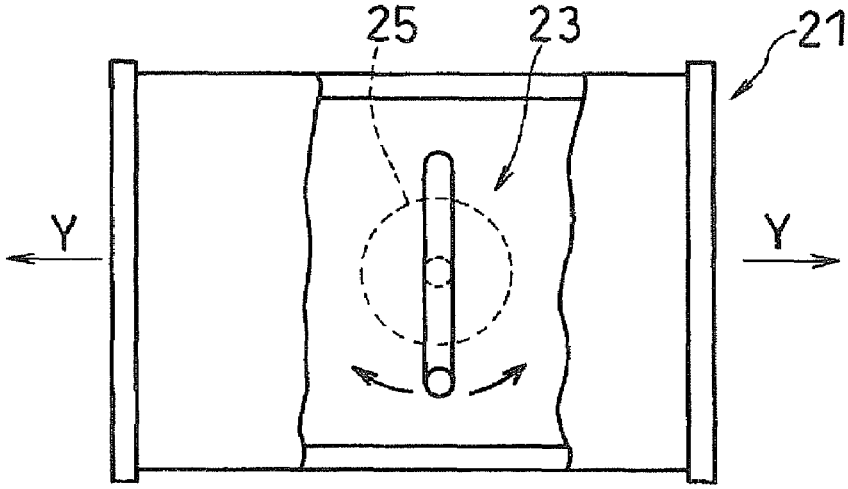
FIG. 5B is a plan view of the correcting conveyor.

The CPU 4 moves the correcting conveyor 21 shown in FIG. 5B to the left or right (in the width direction Y) to correct the misalignment of the product M, according to the second amount of misalignment calculated by the second misalignment calculating unit 42 based on the second video signal. Specifically, the motor 25 rotates only a rotation angle corresponding to the amount of misalignment to move the correcting conveyor 21 carrying the product M in the width direction Y, and correct the misalignment of the product M in FIG. 5A in the width direction Y.

Misalignment Correction in Conveying Direction X

The conveying bar 13 is driven by a drive motor 16 provided with a rotary encoder (part of the detection unit) 15 shown in FIG. 4, for example. The position of the conveying bar 13 is calculated by the CPU 4 based on a detection signal (rotation signal) from the rotary encoder 15. Meanwhile, the rear end Tb of the product M (tray T) is detected by the camera 2, as shown in FIG. 7G.

The second misalignment calculating unit 42 is included in the CPU 4. The second misalignment calculating unit 42 detects the amount of misalignment of the product M in the conveying direction based on the positional relationship between the conveying bar 13 and the rear end Tb of the product M.

Figure 7A:
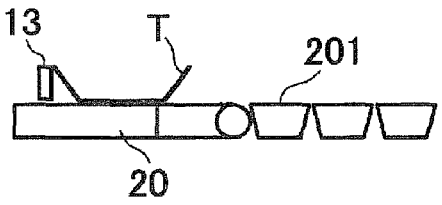
FIGS. 7A through 7H are schematic elevation views showing the manner in which a product on the supply device is conveyed.
Figure 7B:
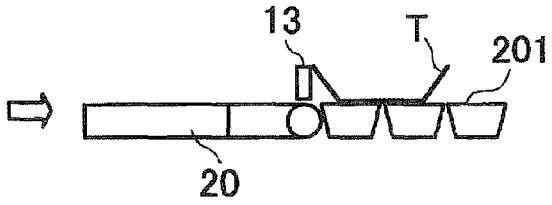
Figure 7C:
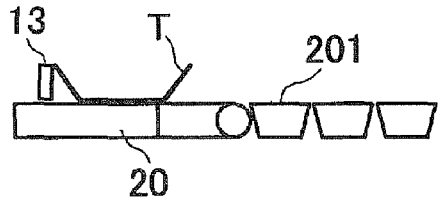
Figure 7D:
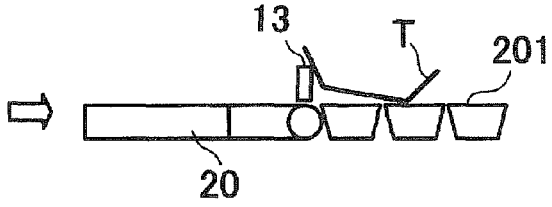
Figure 7E:
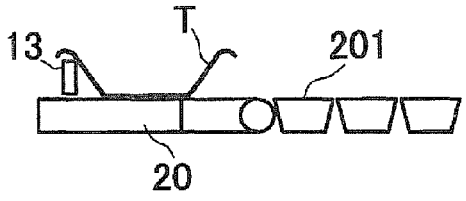
Figure 7F:
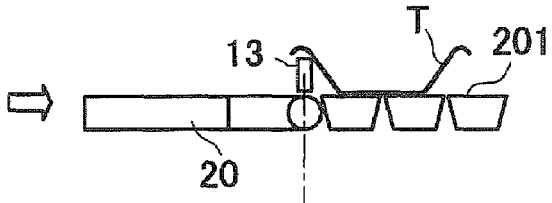

The conveying bar 13 herein sometimes slips in underneath the product M while the product M is being conveyed, as shown in FIGS. 7D and 7F. In such cases, the position of the conveying bar 13 differs from the position of the rear end Tb of the product M.

Figure 7G:
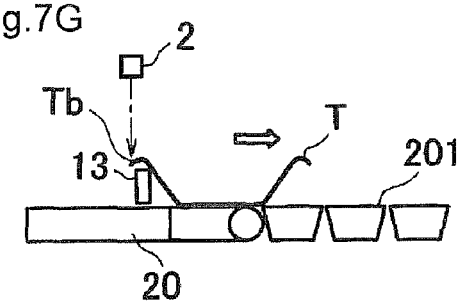
Figure 7H:
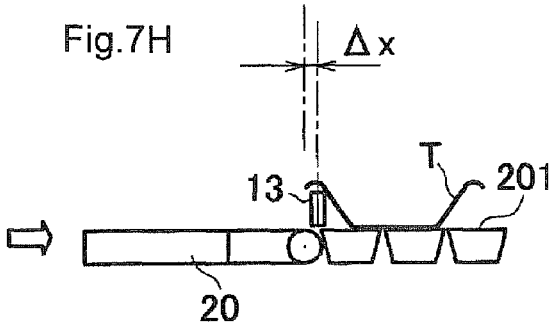

The second misalignment calculating unit 42 compares the position of the rear end Tb of the product M, as detected based on the second video signal from the camera 2, with the position of the conveying bar 13 at the time the photograph was taken, as shown in FIG. 7G, and calculates the amount of misalignment $\Delta x$ in the conveying direction X. As shown in FIG. 7H, the CPU 4 moves the front end of the conveying bar 13 forward by the distance of $\Delta x$ according to the amount of misalignment $\Delta x$ in the conveying direction X, whereby the product M is conveyed to a specific position on the lifter 201, and the misalignment in the conveying direction X is corrected.

Specifying the Tray T

Referring to FIG. 4A, the product information storage unit 50 stores the product name, the price, the position where the label is attached, and other such information, as well as the scheduled tray number to be used, for each product, according to the access number of the product in FIG. 4B. In addition, the size of the tray T, including the width and depth of the tray T, is stored for each type of tray T in the tray information storage unit 51, shown in FIG. 4C.

The CPU 4 identifies the type of tray T based on the second video signal of the product M, after the product M has begun to be conveyed. The size information corresponding to the tray T and other such information is read by the CPU 4 from the tray information storage unit 51 according to the type of tray T identified.

Operation Description

Next, the operation and the manner in which the system is used will be described.

First, the operator inputs the access number of the product and other such information from the touch screen 10 and the keyboard unit 11 shown in FIG. 1. The operator then places the tray T (product M) having contents therein on the first conveying surface 102 of the tray supply device 20, as shown in FIG. 2. When the product M is in place, a weight signal is outputted from the weighing unit 106, shown in FIG. 4A, to the microcomputer 3. When the weight signal stabilizes, a first video signal is sent from the CCD camera 2 to the image processing unit 40.

Then, the first misalignment calculating unit 41 calculates the amount of misalignment (Y1−Y2)=Δy1 of the product M, as shown in FIG. 4A, in the width direction Y, and compares the absolute value of the amount of misalignment (Y1−Y2) with a reference value YS. The CPU 4 outputs a first correction command and a first misalignment amount Δy1 to the weighing, packaging, and pricing control unit 14 when the absolute value of the amount of misalignment (Y1−Y2) is equal to or greater than the reference value YS.

When the first misalignment amount (initial misalignment amount) Δy1 exceeds a specific amount, the motor 25 is rotated to move the correcting conveyor 21 in advance by a distance equal to Δy1 in the direction opposite the correcting direction. This makes it possible to accommodate even greater amounts of misalignment.

After the weight signal is stabilized, the driving chain 104 in FIG. 2 is driven according to a specific sequence, and the conveying bar 13 begins to push on the product M. When the conveying bar 13 reaches a specific position P, the camera 2 photographs the product M, and a second video signal is sent to the image processing unit 40. The second misalignment calculating unit 42 calculates a second misalignment amount Δy2 and compares the absolute value of the second misalignment amount Δy2 with the reference value YS. The CPU 4 outputs a second correction command and the second misalignment amount Δy2 to the weighing, packaging, and pricing control unit 14 when the absolute value of the second misalignment amount Δy2 is equal to or greater than the reference value YS.

In addition, the CPU 4 identifies the type of tray T based on the second video signal, which is taken after the orientation of the tray T has been corrected by the pushing of the conveying bar 13. The CPU 4 obtains the size information and other such information corresponding to the tray T from the tray information storage unit 51, according to the type of tray T identified.

The product M is transferred from the first conveying surface 102 onto the second conveying surface 22*a* of the correcting conveyor 21. When the product M has been completely transferred onto the correcting conveyor 21, the misalignment of the product M is corrected as follows.

Specifically, the weighing, packaging, and pricing control unit 14 to which the correction commands are inputted rotates the motor 25, shown in FIG. 3, by a rotation angle corresponding to the second misalignment amount (the final misalignment amount). The drive arm 24 and the engaging pin 23*b* rotate in accordance with the rotation of the motor 25, the conveyor 22 moves a certain amount in the width direction Y, and the misalignment of the product M in the width direction Y is corrected.

The second conveying surface 22*a* is herein moved by a distance equal to Δy2 when the first misalignment amount Δy1 is less than the reference value YS, and the second misalignment amount Δy2 is greater than the reference value YS. On the other hand, when both the first and second misalignment amounts Δy1 and Δy2 are greater than the reference value, the second conveying surface 22*a* is moved by a distance equal to (Δy2−Δy1).

The misalignment in the conveying direction X is also corrected while the product M is being conveyed.

The second misalignment calculating unit 42 calculates the position of the rear end Tb of the product M based on the second video signal processed by the image processing unit 40. The second misalignment calculating unit 42 also calculates the position of the conveying bar 13 based on a signal from the rotary encoder 15. The second misalignment calculating unit 42 compares the position of the rear end Tb of the product M with the position of the conveying bar 13, and calculates the amount of misalignment in the conveying direction X. The CPU 4 moves the front end of the conveying bar 13 forward by a distance of Δx according to the misalignment amount Δx in the conveying direction X, as shown in FIG. 7H. As a result of this operation, the product M is conveyed to a specific position on the lifter 201, and the misalignment in the conveying direction X is corrected.

The product M, shown in FIG. 2, is pushed by the conveying bar 13 and transferred onto the lifter 201. The specific packaging operation described above is then performed. Meanwhile, the correcting conveyor 21 returns to its original position.

Second Embodiment

In the first embodiment of the present invention, the misalignment was corrected by moving the product M according to the amount of misalignment of the product M. In the second embodiment of the present invention, the product M is not moved, instead, the film F is moved in the width direction Y of the product M according to the amount of misalignment of the product M.

Figure 10A:
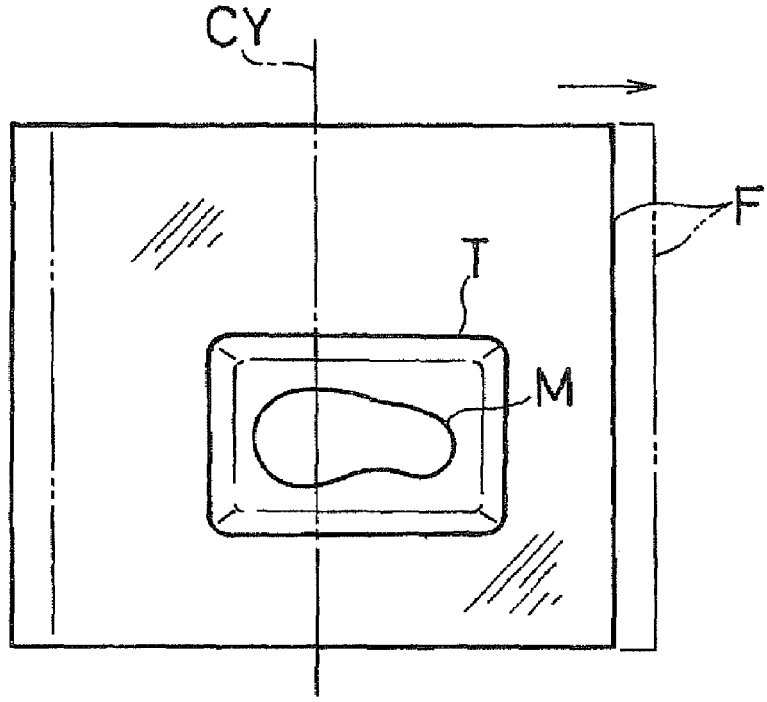
FIGS. 10A and 10B are plan views showing a tray and a film used in a system according to a second embodiment of the present invention.

As shown in FIG. 10A, the product M is conveyed while the misalignment thereof from the center line CY (reference line C) in the width direction Y of the lifter 201 remains uncorrected. The CPU 4 calculates the final amount of misalignment of the product M based on the second video signal that is photographed by the camera 2. The CPU 4 drives the film supply device 202 (shown in FIG. 8) according to the amount of misalignment, and moves the film F to a position (shown by the dashed line in FIG. 10A) in the width direction Y according to the misalignment of the product M.

Figure 10B:
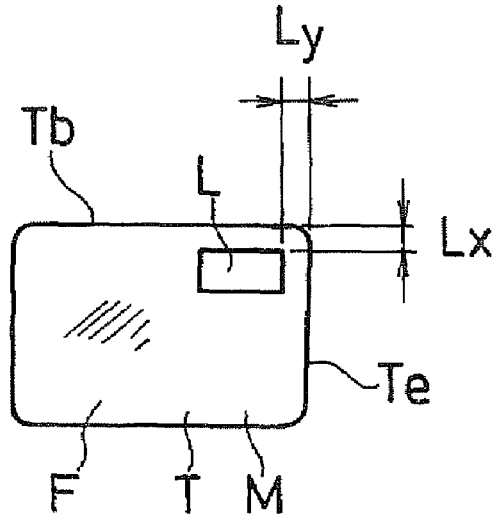

Then, as shown in FIG. 10B, a label L is attached by a label attaching device 12 (shown in FIG. 1) to the top surface of the product M that is wrapped by the film F. According to the amount of misalignment of the product M, the transverse distance Ly of the label L, which is the distance from the edge Te of the product M to the attached position, is changed. Moreover, the longitudinal distance Lx of the label, which is the distance from the rear end Tb of the product M to the attached position, is also changed. Specifically, the horizontal distance Ly is calculated by adding the amount of misalignment of the product M in the width direction Y to a pre-set distance Ly. Similarly, the longitudinal distance Lx is calculated by adding the amount of misalignment of the product M in the conveying direction X to a predetermined distance.

Third Embodiment

Referring now to FIGS. 11 to 14, a packaging system in accordance with a third embodiment will now be explained. The third embodiment of the present invention is largely similar to the first embodiment of the present invention, shown in FIGS. 1 through 9, in terms of the configuration, function, and operation thereof.

Figure 11:
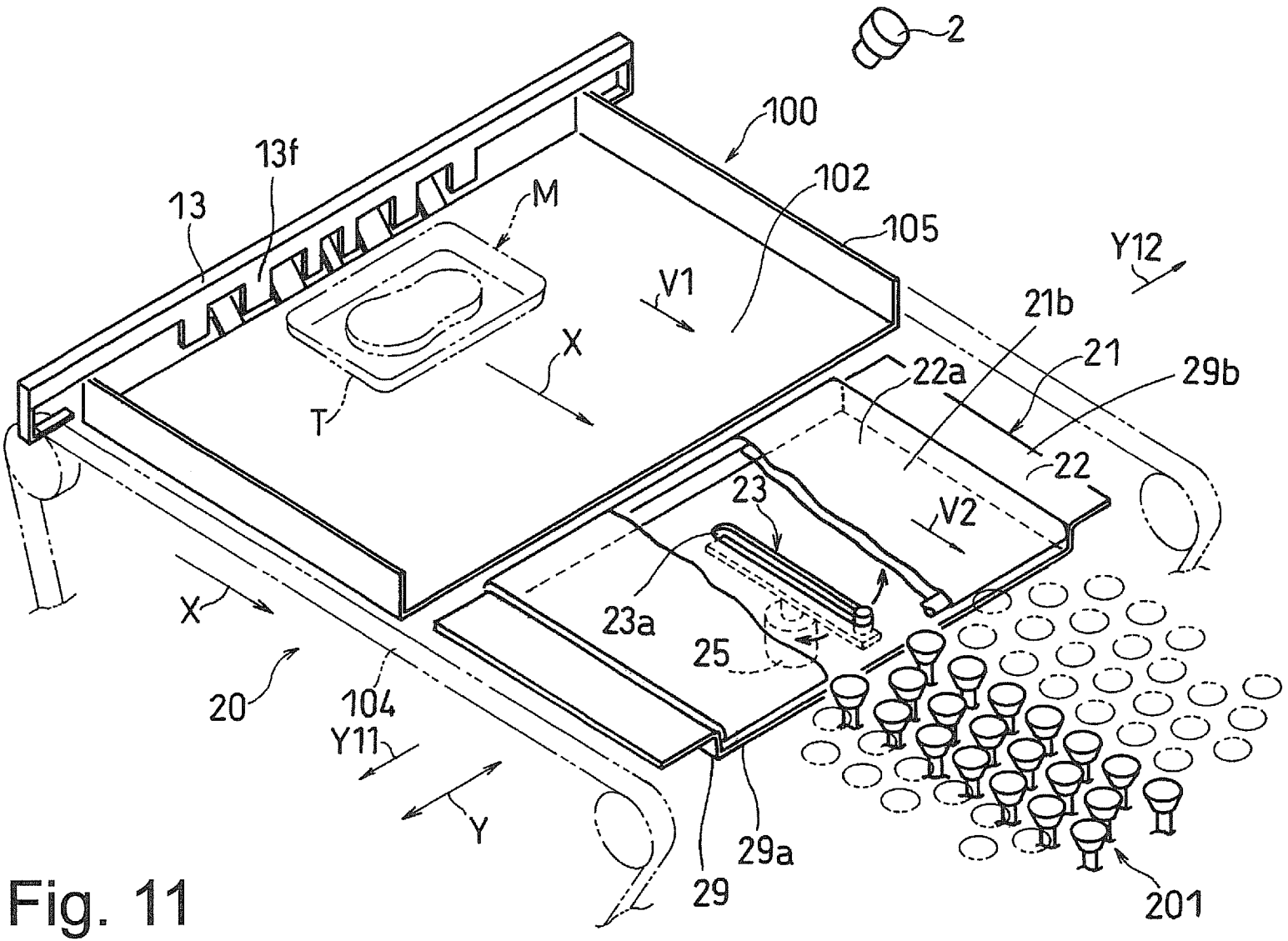
FIG. 11 is a partial cross-sectional, schematic perspective view showing the structure of a supply device in a packaging system according to a third embodiment of the present invention.

In FIG. 11, the correcting conveyor 21 is comprised of a moving plate 29 arranged below a conveyor belt 21*b* that constitutes the second conveying surface 22*a*. A cam groove 23*a*, similar to the one in FIG. 3, is formed in the moving plate 29, whereby the moving plate 29 is capable of moving in the width direction Y.

Specifically, the second conveying surface 22*a* is provided downstream of the first conveying surface 102 in order to convey the product M received from the first conveying surface 102 to the lifter 201. The second conveying surface 22*a* is formed separately from the first conveying surface 102, and configured to be movable within a specific range in the first and second width directions Y11 and Y12 that are substantially orthogonal to the conveying direction X of the product M. The width of the second conveying surface 22*a* is smaller than the width of the first conveying surface 102. However, the size of the moveable range of the second conveying surface 22*a* is approximately corresponds to the width of the first conveying surface 102. The moving unit 23 displaces the position of the product on the second conveying surface 22*a* in the width direction Y by moving the second conveying surface 22*a* in the width direction Y within the moveable range.

Figure 12:
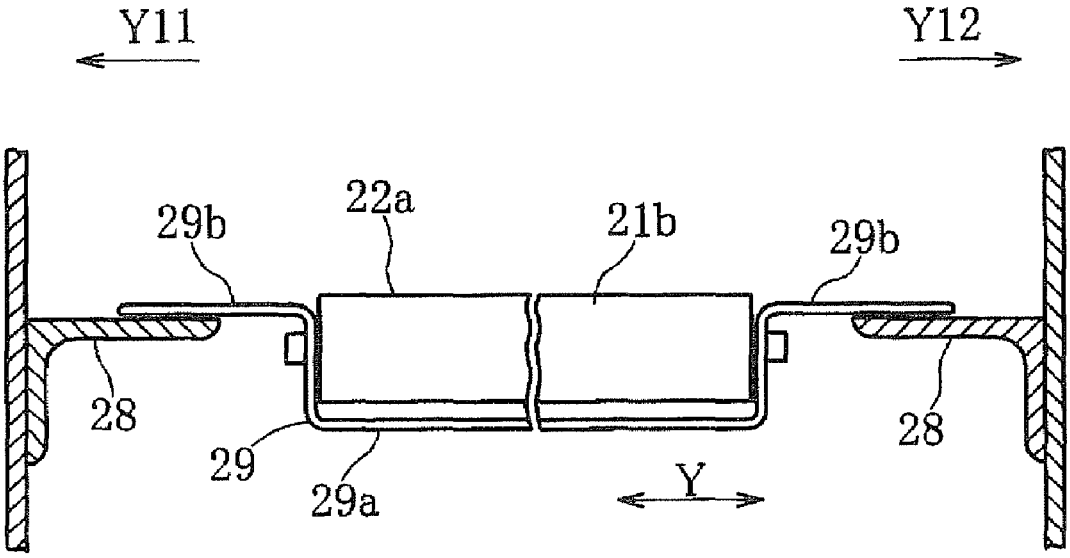
FIG. 12 is a partial cross-sectional view of a conveyor.

As shown in the cross section in FIG. 12, the moving plate 29 has a curved cross section, and comprised of a supporting unit 29*a* having concave shape in the mid-section thereof and disposed below the correcting conveyor 21*b*, and a pair of exposed parts 29*b* protruding to the left and right sides of the second conveying surface 22*a* and formed integrally with the supporting unit 29*a*. The top surfaces of the exposed parts 29*b* are formed to be slightly lower in height than the top surface of the second conveying surface 22*a*, whereby the exposed parts 29*b* do not interfere with the conveying of the product M by the second conveying surface 22*a*.

Fixing covers 28 are arranged at the left and right ends of the moving plate 29. The ends of the exposed parts 29*b* and the ends of the fixing covers 28 overlap each other, even when the correcting conveyor 21*b* moves to the very left or very right end within the moving range, whereby the contents of the tray T will be prevented from falling under the conveyor 22, shown in FIG. 11.

In accordance with the direction of misalignment and the amount of misalignment in the width direction Y as detected by the camera 2, the microcomputer (control unit) 3 (shown in FIG. 4A) drives the moving unit 23 before the product M is conveyed onto the second conveying surface 22*a*, and moves the second conveying surface 22*a* in advance in the first or second width direction Y11, Y12. The microcomputer 3 drives the moving unit 23, after the product M has been conveyed onto the second conveying surface 22*a*, and moves the second conveying surface 22*a* in the first or second width direction Y11, Y12, that is opposite the previous width direction, to correct the misalignment of the product M in the width direction. In the present embodiment, the misalignment of the product M is corrected regardless of the extent of the misalignment of the product M in the width direction Y.

The conveying unit conveys the product M from the first conveying surface 102 onto the lifter 201 via the second conveying surface 22*a*. The conveying unit is comprised of a conveying bar 13 that comes into contact with the rear end of the product M on the first conveying surface 102 and configured to convey the product in the conveying direction, a driving chain 104 (first conveying unit), and a motor 25 (second conveying unit) configured to move the second conveying surface 22*a* along the conveying direction Y. The second conveying speed V2 of the second conveying unit is set to a higher value than the first conveying speed V1 of the first conveying unit.

Before describing the operation of the supply device according to the present embodiment, the disadvantages in the case that the second conveying surface 22*a* is not moved in advance, but rather, the second conveying surface 22*a* is moved in the width direction Y after the product M is conveyed onto the second conveying surface 22*a* will now be described.

Figure 13A:
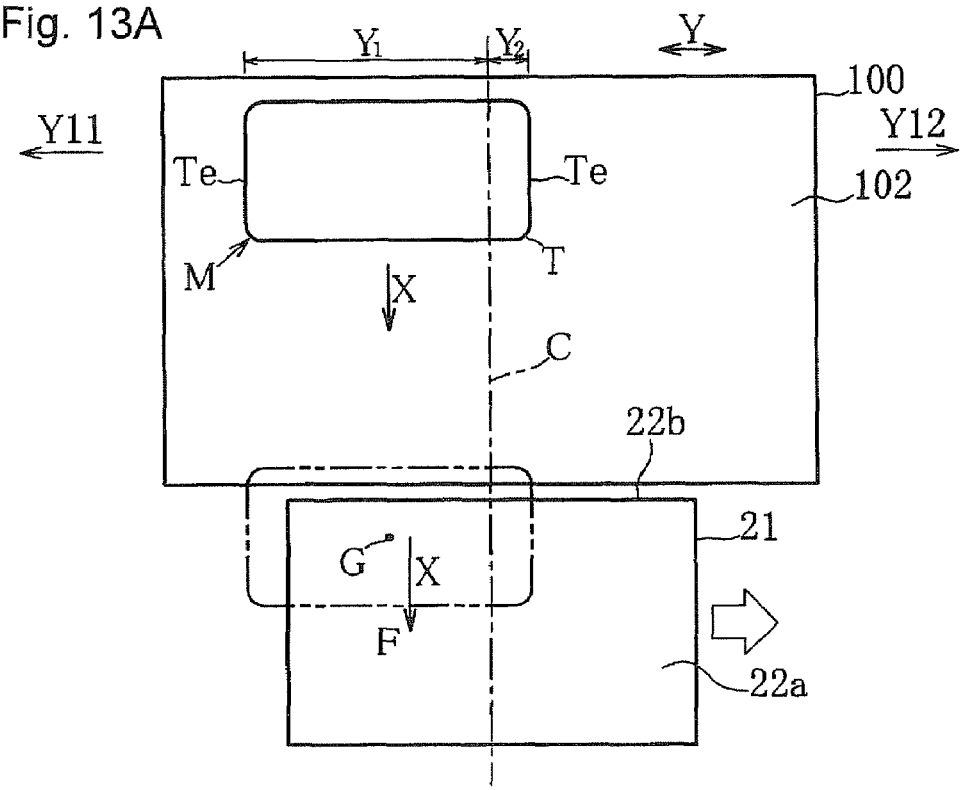
FIGS. 13A and 13B are schematic plan views showing the manner in which the position of a product is disoriented when the product is conveyed from a first conveying surface to a second conveying surface.
Figure 13B:
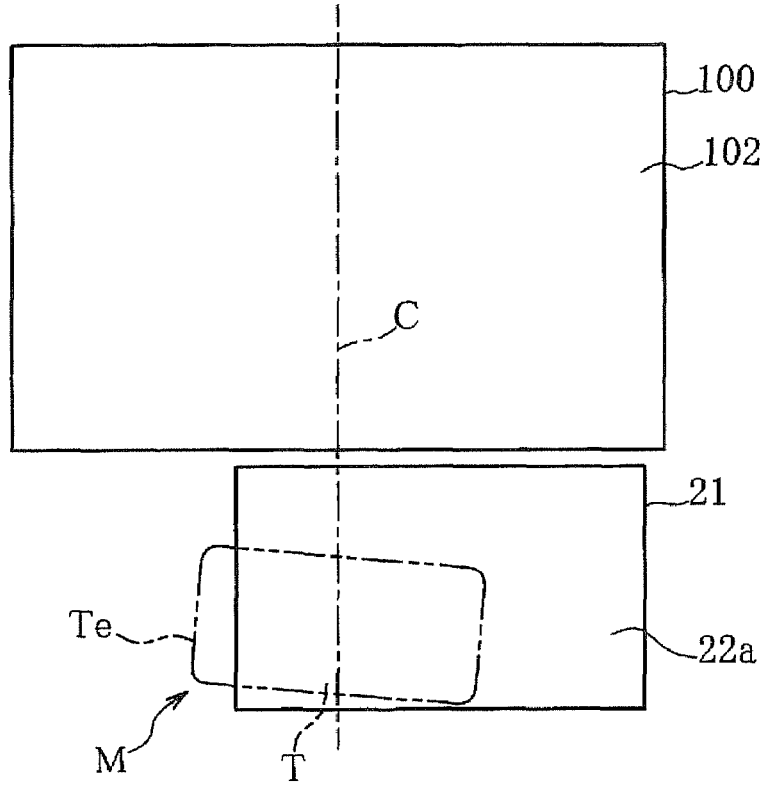

As shown in FIG. 13A, when the second conveying surface 22*a* is moved in the width direction Y after the product M placed on the first conveying surface 102 is conveyed onto the second conveying surface 22*a*, the tray T sometimes could protrude in the width direction Y out of the second conveying surface 22*a*, as shown by the dashed line. In this situation, the frictional conveyance force F applied by the second conveying surface 22*a* to the bottom surface of the tray T is misaligned with the center of gravity G of the product M. Therefore, a moment acts around the tray T, which prevents the tray T from being conveyed in a sufficiently stable manner, and easily results in the disorder of the orientation of the tray T, as shown in FIG. 13B.

Next, the operation of the supply device 20 according to the third embodiment of the present invention will be described with reference to FIG. 14.

Figure 14A:
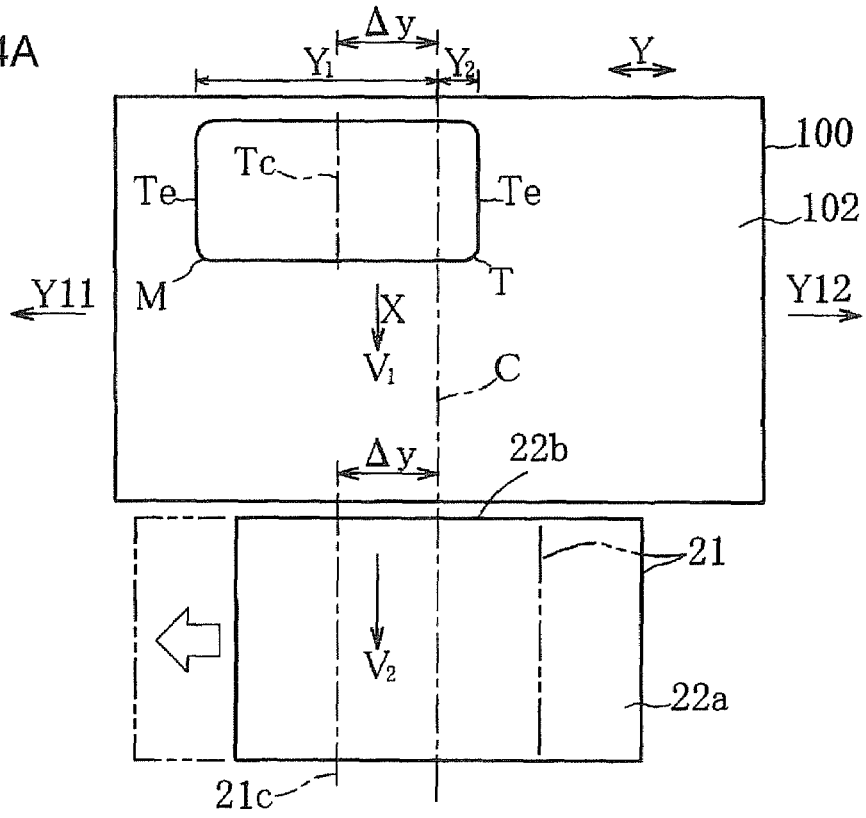
FIGS. 14A and 14B are schematic plan views showing the manner in which a product is conveyed smoothly from the first conveying surface to the second conveying surface.

When the product M is placed on the first conveying surface 102, as shown in FIG. 14A, the distances Y1 and Y2 are determined with a specific timing. Moreover, the misalignment amount Δy in the width direction Y and the misalignment directions Y11 and Y12 are calculated by the method described in the first embodiment of the present invention. Based on the calculated results, the second conveying surface 22*a* moves in the width direction Y by a distance equal to the amount Δy, which is the misalignment amount Δy of the product M in the direction of misalignment, as shown by the dashed line, before the downstream end of the product M or the center of gravity G of the tray T (generally the geometric center of the tray) is conveyed to the upstream end 22*b* of the second conveying surface 22*a*.

Figure 14B:
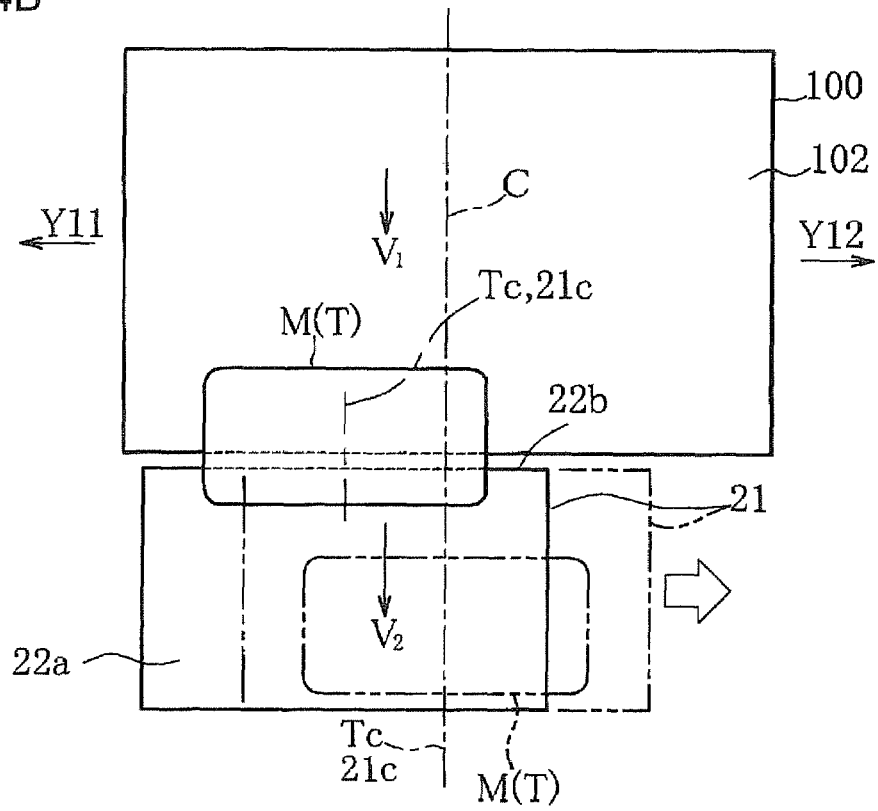

When the position of the tray T is not tilted as shown in FIG. 14B, the centers Tc and 21*c* of the tray T and the second conveying surface 22*a* in the width direction Y nearly align with each other as a result of the movement.

After the movement, when the tray T begins to be transferred onto the second conveying surface 22*a*, as shown by the solid line in FIG. 14B, or when the entire tray T is completely transferred onto the second conveying surface 22*a*, the second conveying surface 22*a* moves in the direction opposite the previous movement direction by a distance equal to Δy, as shown by the dashed line. The centers of the tray T and the correcting conveyor 21 in the width direction thereby nearly align with each other, as shown by the dashed line. Specifically, the product M is centered.

Since there is no danger of the tray T protruding in the width direction Y out of the second conveying surface 22*a* during the transfer, there is also no danger of the tray T being tilted, like the situation shown in FIG. 13B that was previously described. In other words, a stable conveyance of the tray T can be expected, in which the tray T is conveyed without being tilted, as shown by the dashed line in FIG. 14B. As a result, an excellent packaging finish can be expected.

However, since the pushing surface 13*f* of the conveying bar 13 shown in FIG. 11 is formed in a comb-teeth pattern with many notches, if the tray is soft, the rear end of the tray T sometimes is caught in the gaps of the pushing surface 13*f* during the conveyance. Therefore, when the second conveying surface 22*a* moves in the width direction Y, there is a danger that the rear end of the tray T will be caught on the pushing surface 13*f* of the conveying bar 13, which could disorient the position of the tray T, or the specific movement amount Δy in the width direction Y might not be achieved.

The same problem also occurs when the product M, after packaged with a film, is weighed and priced. More specifically, because the product M has already been packaged and the stretched film is highly viscoelastic, the rear end of the product M may adhere to the pushing surface 13*f*, and with the frictional force, it may stick to the pushing surface 13*f*. Therefore, there is a danger of the disorientation of the position of the product M, similar to the situation previous described.

Accordingly, in the present embodiment, the conveying speed V2 of the conveyor 22 is set to a higher value than the conveying speed V1 of the conveying bar 13. Therefore, when the tray T begins to be transferred onto the second conveying surface 22*a* as shown by the solid line in FIG. 14B, the rear end of the tray T begins to separate from the pushing surface 13*f* that is shown in FIG. 11. Therefore, there is no danger that the movement of the tray T in the width direction Y will be hindered by the comb tooth-shaped pushing surface 13*f*. In addition, there is no danger of the disorientation of the position of the product M or the specific movement amount Δy not achieved. As a result, an excellent packaging finish can be expected.

In the present embodiment, the misalignment amount Δy in the width direction, illustrated in FIG. 14A, and the direction of misalignment may be determined only prior to the time the tray T is conveyed after it is placed on the conveyor, only after the tray begins to be conveyed, or both before and after the tray begins to be conveyed.

In addition, in this embodiment, there is no need to move the second conveying surface 22*a* by a distance corresponding to the entire misalignment amount Δy determined. For example, the misalignment may be corrected by first determining the first misalignment amount Δy1 in the width direction on the first conveying surface 102 before the tray begins to be conveyed, and then determining the second misalignment amount Δy2 in the width direction after the tray begins to be conveyed, and moving the second conveying surface 22*a* in one width direction Y in advance by an amount equal to Δy1 before the tray T begins to be transferred onto the second conveying surface 22*a*, and then moving the second conveying surface 22*a* in the other width direction Y (opposite the previous width direction) by a distance of (Δy2−Δy1) after the tray T is transferred onto the second conveying surface 22*a*. In this case, the second conveying surface 22*a* is moved by a distance equal to Δy2, and returned to its original position after the misalignment is corrected.

Furthermore, the second conveying surface 22*a* may be moved twice in advance so as to accommodate both the two determined misalignment amounts Δy1 and Δy2. Specifically, the second conveying surface 22*a* may be immediately moved in advance by a distance equal to Δy1 after the first misalignment amount Δy1 of the tray T is determined, and the second conveying surface 22*a* may be immediately moved in advance by a distance equal to (Δy2−Δy1) after the second misalignment amount Δy2 of the tray T is determined.

There is also no need for the tray to be completely centered. For example, the second conveying surface 22*a* may be moved in advance by a distance equal to only one of the determined misalignment amounts Δy1 or Δy2.

Figure 15A:
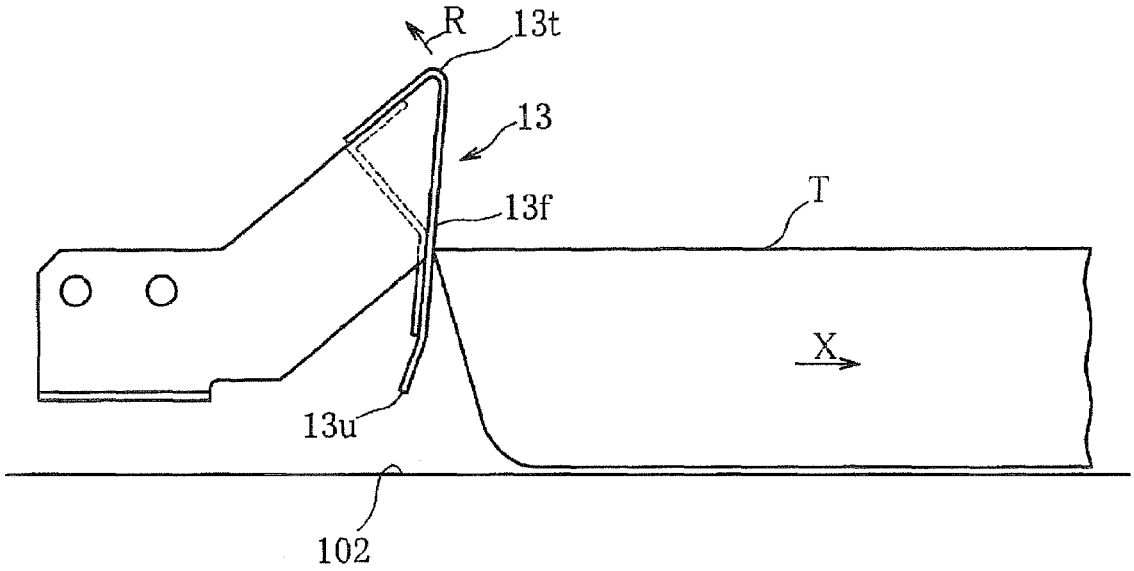
FIGS. 15A and 15B are elevation views showing a modification of the conveying bar.
Figure 15B:
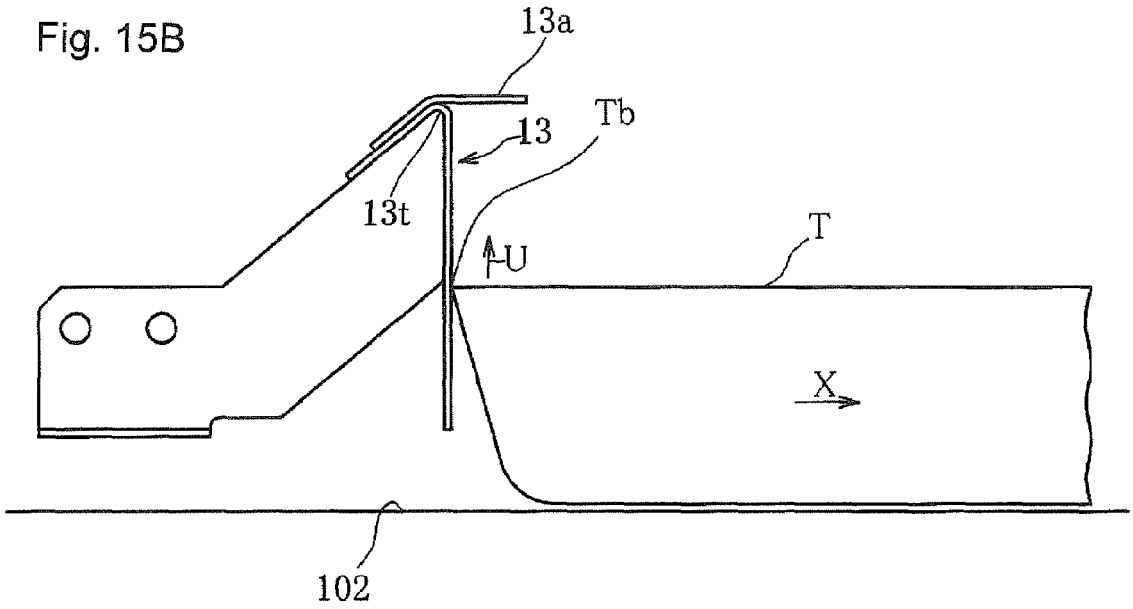

FIGS. 15A and 15B show the preferred shapes and structures of the conveying bar 13 that will prevent the tray from turning over. As shown in FIG. 11, the conveying bar 13 is rotatably driven by a driving chain 104 such as a roller chain, for example. Since a small gap is formed between the pins and rollers in the roller chain, the conveying bar 13 shown in FIG. 15A is rotated to slightly rise in the direction of the arrow R when encountering the gaps. In this case, the angle formed by the pushing surface 13*f* of the conveying bar 13 that pushes the tray T increases, and there is a danger that the tray T will be scooped up and overturned from underneath.

The conveying bar 13 shown in FIG. 15A is inclined in the conveying direction X, such that the top end 13*t* extends farther in the direction X than the bottom end 13*u*. Therefore, the danger that the tray T will be scooped up from underneath is thereby eliminated, even if the conveying bar 13 is slightly rotated so as to rise up in the direction of the arrow R.

The position of the center of gravity in the product M is sometimes off centered in the conveying direction X. In this case, there is a danger that the rear end Tb of the tray T shown in FIG. 15B will rise up in the direction U, and the product M will be overturned when the conveying bar 13 pushes the tray T.

In FIG. 15B, an overhanging member 13*a* is fixed in place at the top end 13*t* of the conveying bar 13. This overhanging member 13*a* protrudes from the top end 13*t* to a greater distance in the conveying direction X than the top end 13*t*. Therefore, it is possible to prevent the product M from being overturned even if the rear end Tb of the tray T rises up in the direction U.

Modification A

The amount of misalignment of the product M may be determined by aligning a plurality of reflective light quantity detectors in the width direction Y.

Modification B

In addition, in the first embodiment of the present invention, it is not necessary to move the conveyor 22 in advance according to the amount of misalignment of the product M in the width direction Y. Alternatively, the conveyor 22 may be moved in advance in the width direction according to the second misalignment amount.

Modification C

Moreover, in the first and third embodiments of the present invention, the second conveying surface 22*a* is formed on the surface of the belt of the conveyor 22. However, the second conveying surface 22*a* may be formed on the surface of a resinous flat plate or a roller, or the like. Furthermore, the amount of misalignment of the product may be corrected by a guiding member or the like, instead of the conveyor 22.

Modification D

In the first and third embodiments of the present invention, the position of the conveying bar 13 in the conveying direction X was specified by an encoder provided to the drive motor of the conveying bar 13. However, the position of the conveying bar 13 may be specified by the rotational position of the driving chain 104, or directly detected by using an optical sensor or the like.

Modification E

In addition, as another example of a packaging system to which the present invention is applied, instead of the folded packaging as exemplified in the previous embodiments, the present invention can also be similarly applied to a so-called top-sealing packaging device. One example of a top-sealing packaging device is the packaging device disclosed in U.S. Pat. No. 6,666,005.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A packaging system configured to package a product by supplying the product onto a lifter by means of a supply device, lifting the product up to a packaging station, and covering the product with a film on the top surface thereof, the packaging system comprising:

a conveying unit configured to convey the product onto the lifter by contacting a rear end of the product on the supply device in the conveying direction;

a detection unit configured to detect a first amount of misalignment of the product in a width direction that is orthogonal to the conveying direction before the conveying unit contacts the rear end of the product, and to detect a second amount of misalignment of the product in the width direction after the conveying unit contacts the rear end of the product; and a control unit configured to control each unit of the packaging system in accordance with the first and second amounts of misalignment detected; wherein the control unit is configured to correct the misalignment of the product in the conveying direction by driving the conveying unit to convey the product in the conveying direction in accordance with the amount of misalignment in the conveying direction that is detected by the detection unit; the detection unit is configured to detect the position of the rear end of the product and the position of a contract member that comes into contact with the rear end of the product, and to detect the amount of misalignment of the product in the conveying direction based on the position relationship detected between the contact member and the rear end of the product.

2. The packaging system as recited in claim 1, further comprising a moving unit configured to move a position of the product on the supply device in the width direction;

wherein the control unit is configured to corrects the misalignment of the product in the width direction by driving the moving unit to move the position of the product in the width direction in accordance with at least the second amount of misalignment in the width direction that is detected by the detection unit.

3. The packaging system as recited in claim 1, wherein the control unit is further configured to identify a type of tray that forms a part of the product after the conveyance of the tray begins.

4. The packages system as recited in claim 1, wherein the detection unit is further configured to detected an amount of misalignment of the product in the conveying direction.

* * * * *